United States Patent [19]

Gordon et al.

[11] 4,068,739

[45] Jan. 17, 1978

[54] DISASTER EVACUATION AIR CUSHION

[76] Inventors: Donald W. Gordon, 2718 Standish, Anaheim, Calif. 92806; Dar A. Robinson, 9755 Matick, Sepulveda, Calif. 91343

[21] Appl. No.: 675,426

[22] Filed: Apr. 9, 1976

[51] Int. Cl.[2] ..... A62B 1/22

[52] U.S. Cl. ..... 182/139

[58] Field of Search ..... 182/137, 138, 139, 140; 56/329; 5/349, 365, 369; 9/11 A, 11 R; 272/65

[56] References Cited

U.S. PATENT DOCUMENTS 3,851,730 12/1974 Scurlock ..... 182/137

FOREIGN PATENT DOCUMENTS 174,995 4/1971 Sweden ..... 9/11.1

*Primary Examiner*—Reinaldo P. Machado

*Attorney, Agent, or Firm*—Knobbe, Martens, Olson, Hubbard & Bear

[57] ABSTRACT

A disaster evacuation apparatus is disclosed which is particularly useful in the evacuation of victims caught in fires of multistoried buildings, airplane crashes, or similar disasters where the normal escape routes or fire exits have been made inaccessible due to the prevailing circumstances, forcing the victims to leap from high levels to their safety. This rescue unit comprises a large inflated enclosure mounted on a secondary inflated supporting base, both of which are fabricated from extremely lightweight flexible nylon material facilitating easy storage and transportation to the disaster site in the deflated pack-rolled state. The apparatus has the ability of being quickly inflated by its own air blower motor upon delivery to the disaster area. More importantly, the apparatus exhibits instant recovery to its operational configuration after each successive impact of falling bodies.

21 Claims, 6 Drawing Figures

FIG.3.
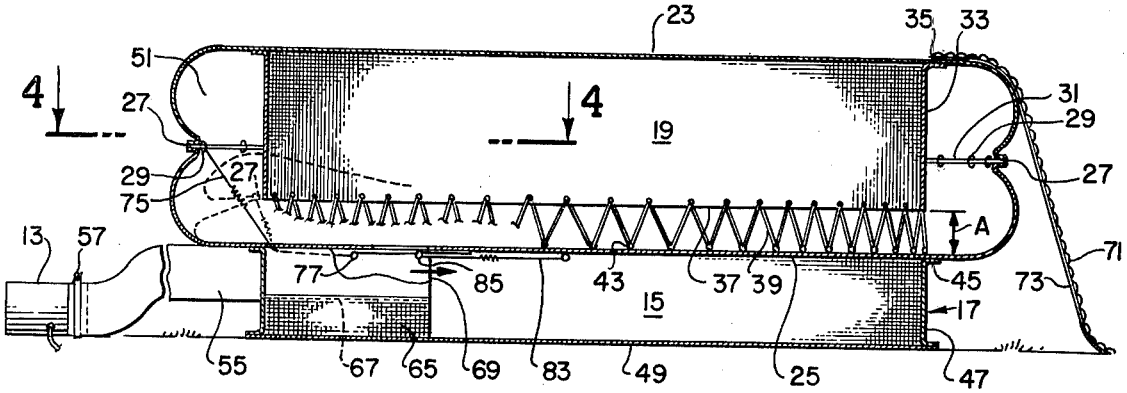
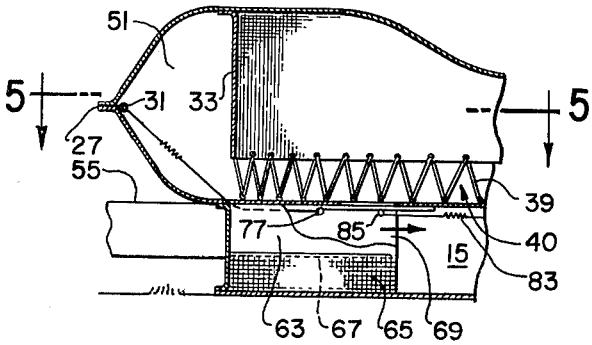
FIG.4.
FIG.5.
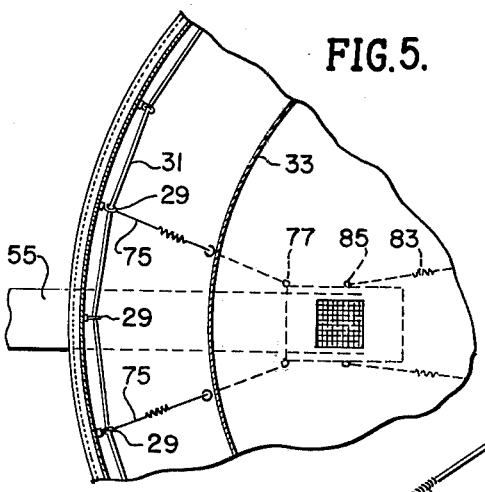
FIG.6.
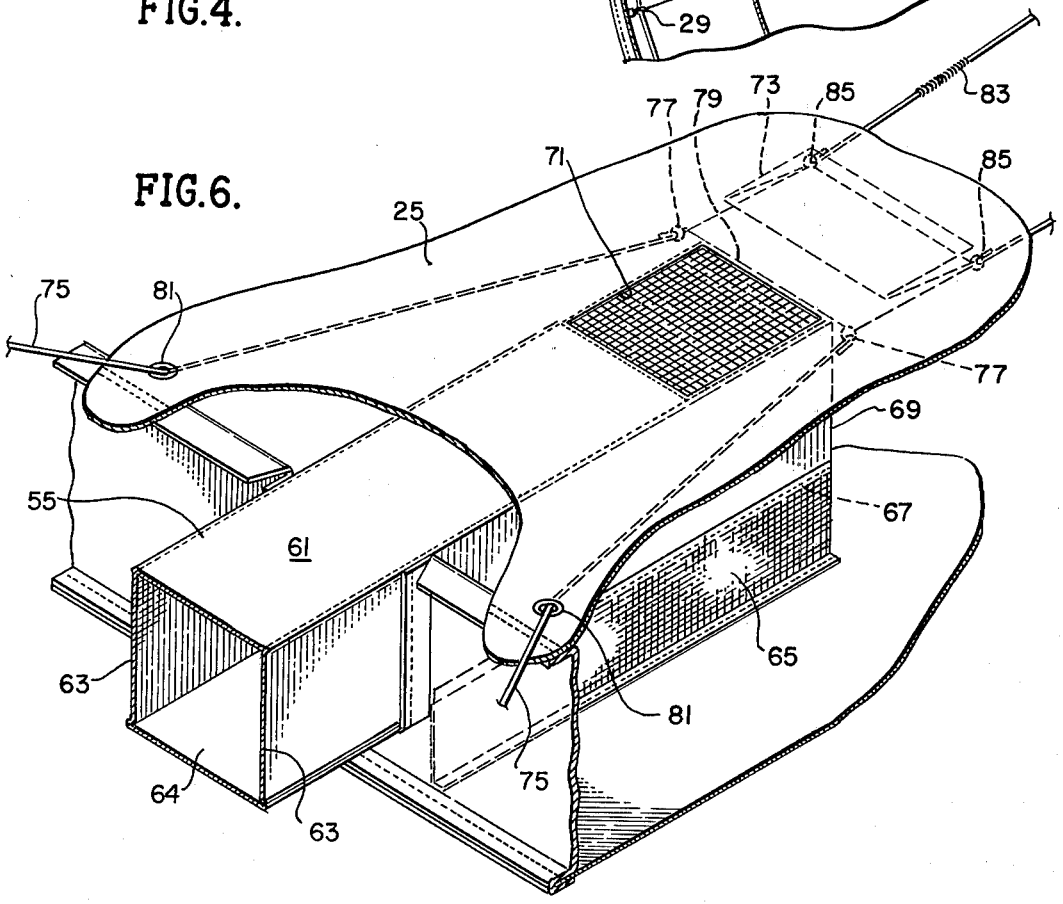

DISASTER EVACUATION AIR CUSHION

BACKGROUND OF THE INVENTION

The present invention relates to an evacuation apparatus and, more particularly, to safety equipment used on the ground level for catching evacuees who are forced to leap from the upper floors of burning multistoried buildings or from other high levels in disaster areas where the normal escape routes or fire exits have been made inaccessible or dangerously impracticable due to the prevailing conditions of the disaster, be it fire, earthquake, or such.

The most commonly used device for retrieving leaping evacuees at a fire disaster site has been the firemen's net, a large circular frame having a flexible fabric lashed therein. This retrieval net requires the strength of six or more persons to hold it suspended above the ground level in the proximity of the leaping fire victims. As can be envisioned, this form of retrieval net, being at least 15 feet in diameter, is unwieldy and awkward to transport to and from the disaster site.

An even more significant limitation of such nets, however, is their inability to provide sufficient cushioning to permit safe jumps from elevations of several stories, such that they are substantially useless for aiding fire victims in high rise buildings.

More recent patents in the art of retrieving falling objects by means of air cushions are cited as follows: Mapes, U.S. Pat. No. 2,906,366 for a Body Catcher; Mitchell and Rollings, U.S. Pat. No. 2,840,194 for a Shock-Absorbing Air Cushion; Warden, U.S. Pat. No. 2,721,048 for a Shock Absorber for Parachute Drops; Stanley, U.S. Pat. No. 2,712,913 for Aerial Drop Equipment; and Frost, U.S. Pat. No. 3,250,065 for a Decelerating Catcher for Moving Objects.

The latter Frost patent, in an alternate fourth form, describes a mobile vehicle comprising a metal chassis or frame upon which is attached a flexible membrane which can be inflated by a pressurizing fluid to form a cushion for catching falling bodies. This cushion has a plurality of orifices which permit a controlled continuous escape of the pressure fluid from the air chamber. The Frost device, when impacted, exhausts a large amount of air to the atmosphere through a controlling orifice to absorb the momentum of the falling object. This air must be replaced by a pump, often requiring 15–25 seconds, before the unit becomes operable for absorbing the momentum of a successive impact. Even though the apparatus seems to be mobile, the heavy chassis mounted on wheels must be towed to its operational site and carefully maneuvered into place.

Other shock-absorbing devices, such as disclosed in the Mitchell/Rollings or the Warden patents, are primarily used for protecting loads dropped from airplanes, with or without the means of a parachute. Each device is equipped with a pressure relief valve or orifice located in its exterior wall that automatically opens when the device is impacted upon reaching the ground, thus partially deflating said device to absorb the momentum of the impact. No means for restoring the air pressure is provided.

SUMMARY OF THE INVENTION

The present invention alleviates many of the disadvantages associated with the prior art, and specifically those of storage, transportation, disposition on the disaster site, slow recovery to operational state, and permanent loss of air pressure upon impact.

All of the above cited disadvantages have been overcome by this invention. This safety device comprises a large, circular, air-inflated cushion, typically measuring at least 30 feet in diameter, a self-contained bifunctional orifice, a complementary chamber for capturing the expelled air, a means for recycling the captured air, and an air-inflated base.

The primary air cushion is attached to a flexible air-inflated base of slightly smaller diameter, and typically at least three feet in height. The supporting base enclosure is inflated by an air blower motor to a higher pressure than the upper primary air cushion, thus providing a secondary safety impact surface. In use, the primary air cushion is inflated with a minimum of air pressure to maintain its basic shape. This condition provides the maximum cushioning effect for absorbing the impact of the falling object, with little or no rebound characteristic.

The primary air cushion is fabricated with an internal, adjustable, circumferential orifice which restricts the expulsion rate of the air from a central impact chamber, thus regulating the deceleration of the impacted body. The expelled air is momentarily captured within a secondary expansion chamber surrounding the central impact chamber. Through the use of an encircling elastic band within the secondary expansion chamber, the air dissipated by an impact is forced to immediately return to the central impact chamber through the same orifice used for controlling air expulsion. Thus, the upper air cushion immediately regains its original state, readied for the next impact. Because the orifice between the primary and secondary air chambers is large in relation to the amount of air expelled during impact, the above re-inflation takes place within a fraction of a second.

All components of this invention are fabricated from extremely lightweight air and water impervious nylon material with no protruding metal parts capable of piercing any of the enclosures. This safety device, when in its deflated state, can thus be folded and rolled into a compact bundle, not unlike a parachute, facilitating easy carrying and storage when not in use.

These and other advantages of the present invention are best understood through a reference to the drawings, in which:

FIG. 3 is a sectional view taken along lines 3—3 of FIG. 1 showing the internal construction details of the disaster evacuation air cushion in its normal inflated state;

FIG. 4 is a partial sectional view taken along lines 4—4 of FIG. 2 showing the relative position of the extreme edge of the inflated upper landing cushion in its expanded state resulting from the impact of the evacuation victim;

FIG. 5 is a partial sectional view taken along lines 5—5 of FIG. 4 showing the flexible closure flap in its closed position; and FIG. 6 is a partial perspective view showing the details of the open flexible closure flap in relation to the air intake aperture.

DETAILED DESCRIPTION OF THE PREFERRED EMBODIMENT

Figure 1:
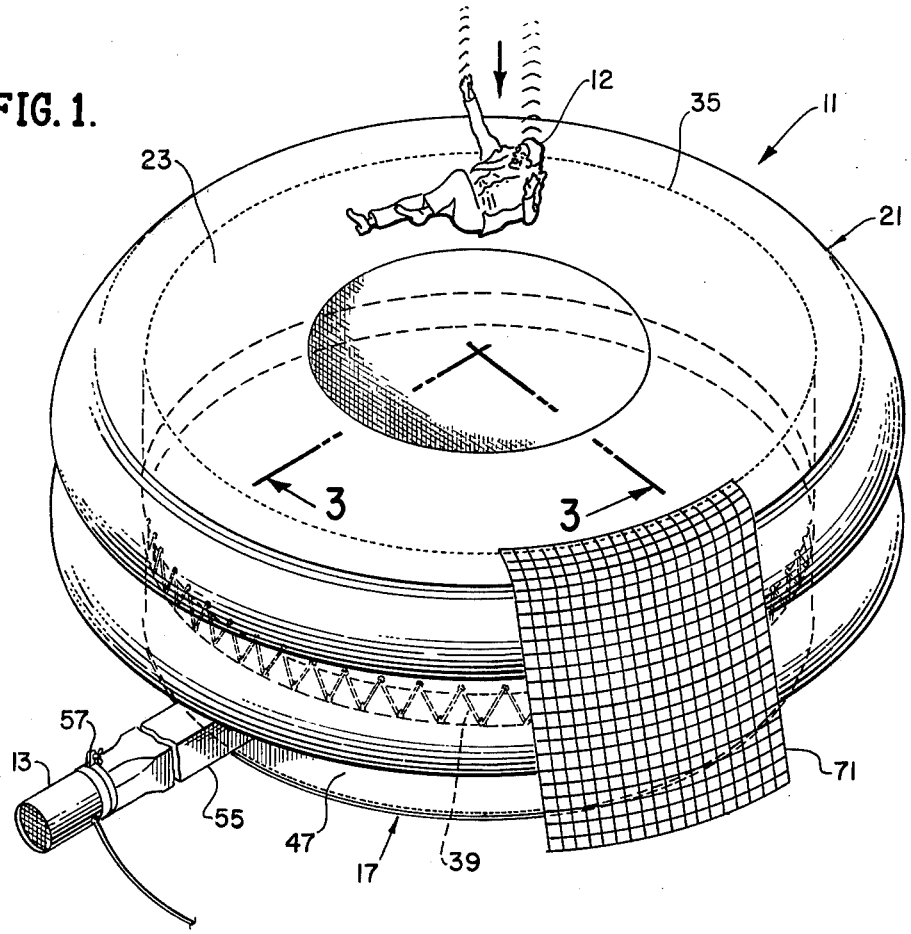
FIG. 1 is a perspective view of the inflated disaster evacuation air cushion showing its configuration before impact of the leaping evacuee.
Figure 2:
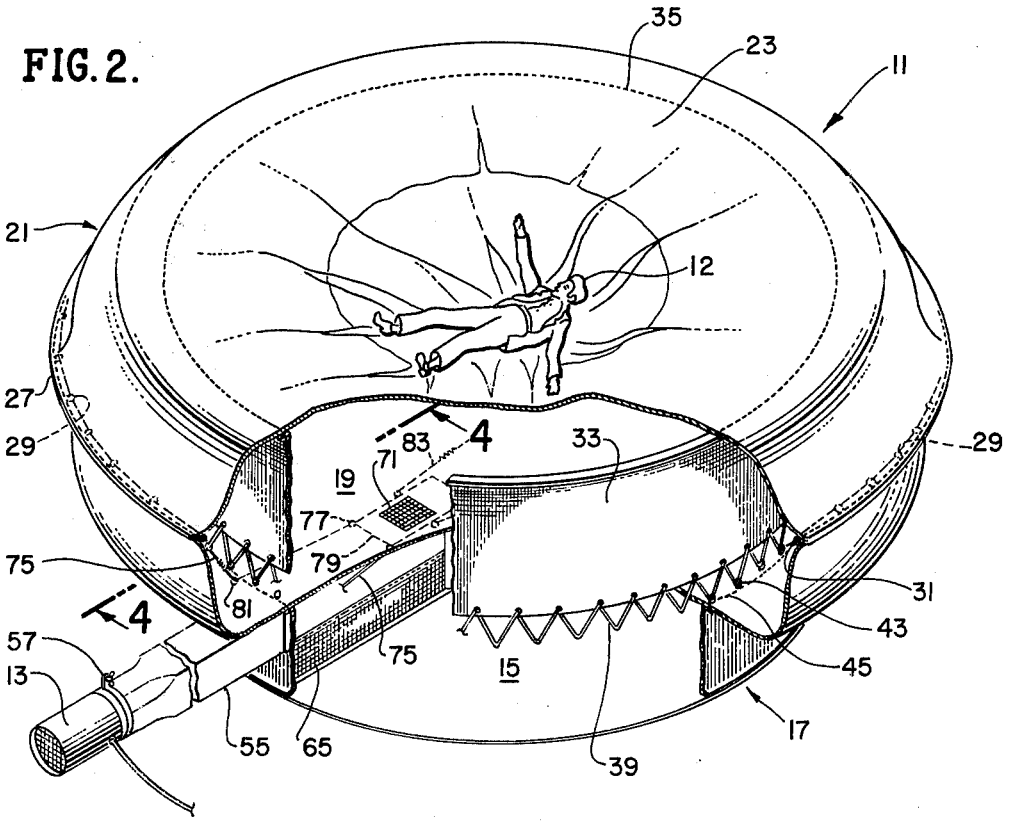
FIG. 2 is a perspective view, partially broken away, of the inflated disaster evacuation air cushion of FIG. 1 showing the configuration and the interrelationship between the various internal components upon impact of the evacuation victim.

Referring initially to FIGS. 1 and 2, a disaster evacuation, air-inflated cushion 11 is shown preceding and following, respectively, the moment of impact of a leaping evacuee 12. Prior to its use in the inflated state shown in FIG. 1, the disaster evacuation air cushion 11 is transported in a collapsed state, folded and rolled into a pack form facilitating easy transportation and storage. At the site of the disaster, in this case reference will be made to afire in a high-rise building, the pack is positioned on the ground approximately 15 feet from the wall of the burning building on the side from which the fire evacuees are forced to leap, unfolded and inflated by an air blower motor 13 which is made operable by any convenient electrical source or generator. When inflated, an air chamber 15 forms a supporting base 17 which is directly pressurized by the blower 13 to an air pressure of approximately 10 pounds per square inch. This pressure may conveniently be controlled, for example, through proper design of the blower 13. Thus, if the impeller of this blower 13 is designed for high volume, low pressure service, it may be incapable, at the design rotational rate, of supporting more than 10 PSI back pressure. It will thus quickly inflate the chamber 15 at low pressure, and will gradually become ineffective for moving air as the internal pressure approaches 10 PSI. Alternatively, the blower 13 may include a pressure actuated switch which automatically cycles the blower motor 13 to maintain a pressure of 10 PSI within the chamber 15.

The supporting base 17 provides two primary functions. Due to the relatively high internal pressure, the base 17 forms a relatively rigid pedestal to assure that the cushion 11 remains upright after repeated impacts, and has no tendency to roll along the ground. In addition, the chamber 15 forms a safety back-up for the primary air chamber so that, if the primary chamber fails to completely stop the evacuee, the chamber 15 will bring him to rest safely.

The air pressure in a central impact chamber 19 of the upper air cushion 21 is maintained at a lesser pressure, typically less than one pound per square inch. This low pressure is selected to be just sufficient to hold the shape of the cushion 21 without lending any rigidity thereto, so that deceleration will be totally controlled by air dynamics, as discussed below, rather than air statics. While the air pressure in the pedestal 17 is maintained constant by means of an electrical air pressure switch which activates the air blower motor when necessary or a satisfactory impeller design, inflation of the chamber 19 is preferably controlled by a flap valve, which will be described in detail later, which is responsive to the shape of the cushion 21 rather than internal pressure. This permits only enough air to enter the chamber 19 to fill out its contours and prohibits any further pressurization.

Referring now specifically to FIGS. 1, 2 and 3, the detailed construction of the disaster evacuation air cushion 11 will be described. The upper air cushion 21 is made of extremely lightweight, air and water impervious nylon material, such as is commonly used for constructing parachutes, comprising a circular top panel 23 and a circular bottom panel 25, joined together at a seamed edge 27. It can be seen that the circular bottom panel 25 also forms the top of the pedestal chamber 15. The seam 27 is preferably formed, as by folding and sewing, to be as impervious to airflow as practical.

Spaced along the interior of the seamed edge 27, a plurality of small rings 29 are attached, as by sewing. An encircling elastic restraining band 31 passes through the plural rings 29 to form a resilient circular band which draws the seamed edge 27 radically inward throughout its circumference, so that the upper air cushion 21 is drawn into a double doughnut shape approximately 30 feet in diameter and 7 feet in height when inflated but before impact, as best shown in FIGS. 1 and 3. The elastic band 31 must have a high enough spring constant to prohibit the low pressure within the chamber 19 from expanding the band 31, but aside from this requirement, the band 31 should be as resilient as possible, to permit expansion on impact, as will be described below.

A cylindrical air baffle panel 33, made of the same air and water impervious nylon material, is sewn at its upper edge in a circular pattern to the top panel 23 of the upper air cushion 21 at the seam 35. The height of the baffle panel 33 is less than the height of the chamber 19 when inflated. The bottom circular edge 37 of the air baffle panel 33 is lashed to the bottom panel 25 by means of a nylon cord 39 passing through a plurality of grommets 41 equally spaced around the bottom edge 37 of the air baffle panel 33 and through a plurality of small rings 43 attached, as by sewing, at a seam 45 joining an exterior circumferential panel 47 of the supporting base 17 to the bottom panel 25. By adjustment of the lashing cord 39 around the circumference of the lower edge 37 of the baffle panel 33, the distance A (FIG. 3) between the lower edge 37 and the bottom panel 25 can be adjusted to vary the size of a difunctional orifice 40. This orifice restricts the expulsion rate of air from the central impact chamber 19 into a surrounding expansion chamber 51 when a falling object or body 12 strikes the surface of top panel 23.

The supporting base 17, which is attached to the upper air cushion 21 at the seam 45, is made of the similar air and water impervious nylon material and comprises a circular bottom panel 49 of smaller radius than panels 23, 25, attached to the exterior circumferential panel 47 at a seamed edge 53. The seam 53 is preferably formed, as by folding and sewing, to be as impervious to airflow as practical. When inflated, the supporting base 17 is typically at least 24 feet in diameter and 3 feet high, allowing an overhang of approximately 3 feet around the circumference of the upper air cushion 21. Referring now to FIGS. 2 - 6, the details of the inflation and re-inflation control apparatus will be described. A flexible air intake sleeve 55 including a top panel 61, side panels 63 and bottom panel 64 is secured to the output end of the air blower motor 13 by means of a strap clamp 57. The air intake sleeve 55, basically square in cross section, enters of air chamber 15 of the supporting base 17 through an opening 59 in the circumferential panel 47. The top panel 61 of the air intake sleeve 55 is sewn to the bottom panel 25 of the upper air cushion 21. The two side panels 63 of the air intake sleeve 55 are stretched taut by means of a pair of nylon net panels 65 sewn at opposite edges to bottom edges 67 of the side panels 63 and the bottom panel 49 of the supporting base 17. Thus, the air intake sleeve 55 is prevented by panels 65 from collapsing during the use of the rescue unit 11, even if the pressure within the chanmber 15 exceeds that in the sleeve 55. The airflow generated by the air blower motor 13 passes unrestricted through the open extreme and 69 of the sleeve 55 and into the air chamber 15.

At the time of the initial inflation of the unit 11 from its totally collapsed state, the air chamber 15 in the supporting base 17 is the first to the inflated. Before the atmosphere in the chamber 15 reaches the present pressure, such as 10 PSI, the supporting base 17 will have taken its full shape. At this time, air begins to flow through a mesh covered air intake aperture 71 opening from the chamber 15 into the impact chamber 19 of the upper air cushion 21. When the upper air cushion 21 inflates to its full double doughnut configuration, as shown in FIGS. 1 and 3, a flexible closure flap 73 is pulled across the air intake aperture 71 by two resilient cords 75 attached to rings 77 sewn to the leading edge 79 of the flap 73. The cords 75 pass through grommeted holes 81 in the bottom panel 25 and are attached to a pair of the rings 29 on the seamed edge 27 of the upper air cushion 21. Thus, when the air cushion 21 becomes inflated to the desired size, the seamed edge 27 is raised and expanded from a position shown in phantom lines in FIG. 3 to its pre-impact operational diameter shown in full lines in FIG. 3, causing the cords 75 to draw the flap 73 to its closed position, covering the aperture 71 and terminating the airflow into the impact chamber 19. The air blower motor 13 continues to operate until the air pressure in the chamber 15 reaches the predetermined pressure. At this time, the operation of the motor 13 is stopped by means of an electrical pressure switch or the impeller moves no additional air, though continuing to rotate.

If the upper air cushion 21 accidently deflates for reasons of puncture or slow air migration through seams, etc., two resilient, flap-opening cords 83 attached to rings 85 on opposite sides of the flap 73 overcome the tension of cords 75 (which now are released due to the collapsed state of the band 31) and withdraw the flap 73 from the aperture 71, permitting air from chamber 15 to enter chamber 19. When the upper air cushion 21 is reinflated, the air intake aperture 71 is covered, as previously described.

The resilience of the straps 75 and 83 is thus balanced, so that, when the seam 27 is in the position shown in FIG. 3, the flap 73 is closed. However, whenever the seam 27 sags inwardlly or downwardly, the resilience of strap 83 overcomes that of 75 to open the flap 73, permitting high pressure air from chamber 15 to inflate chamber 19.

Note should again be made of the fact that the inflation of chamber 19 is not controlled by the pressure therein, but by its size, so that an absolute minimum pressure for size retention may be maintained in the chamber 19.

Those skilled in the art will recognize the fact that numerous alternative systems may be used to inflate the chamber 19. The requirement of any such system must be the ability to inflate only to a very low maximun pressure, such as 1.0 PSI, or to inflate only until size retention of the apparatus is assured, as by monitoring the position of the expansion chamber 51, as with the specific embodiment shown in the drawings. As an example, a pair of blowers may separately supply air to chambers 15 and 19, the blower supplying chamber 15 being capable of supporting a maximum back pressure of 10 PSI, and the blower supplying chamber 19 being capable of supporting a maximum back pressure of 1.0 PSI. Alternatively, each of these separate blowers may be capable of higher back pressures, but each may be controlled by a pressure sensitive switch which cycles the blowers to maintain the desired pressures in each chamber.

Another alternative inflation system which has been successfully tested by the applicants also uses a pair of blowers. A first blower directly inflates the chamber 15 at 10 PSI. A second blower is attached to an air intake sleeve, similar to sleeve 55, but the flap valve manipulated by the cords 77 alternatively supplies the air from this second blower to the chamber 19 or exhausts the air from sleeve 55 directly to the atmosphere. The flap valve thus operates to maintain the chamber 19 inflated to a pressure sufficient for chamber size retention, and all excess blower air is ducted to the atmosphere.

Use of the device is best understood by reference to FIGS. 1 to 4. The baffle panel 33 separates the impact chamber 19 from the expansion chamber 51, so that the bifunctional orifice 40 restricts flow between these chambers. The expansion chamber 51 is maintained, before impact, in a substantially compressed or partially inflated configuration by the resilient band 31, drawing the seam 27 radially inward. Upon impact, the top panel 23 depresses as shown in FIGS. 2 and 4, forcing the air in impact chamber 19 to pass through the restricting orifice 40 under baffle panel 33 to the secondary expansion chamber 51 of the air cushion 21. The additional air pressure in the chamber 51 caused by the impact overcomes the restraining action of the resilient band 31, allowing the seamed edge 27 to expand radially outward to a greater diameter, as shown in FIGS. 2 and 4. Although the flap 73 is assumed to be closed at impact, so that the rings 77 cannot move to accommodate expansion of the seam 27, the resilience of cords 75 permits relatively free expansion, as required. When the force of the impact has been totally absorbed, the resilient band 31 draws the seam 27 radially inward to its original diameter, as shown in FIGS. 1, 3, thus forcing the expelled air to return to the central impact chamber 19 through the bifunctional orifice 40 below the circular baffle panel 33. Thus, the above described feature of this invention prevents any dissipation of expelled air to the atmosphere and permits the recovery of the air cushion 21 to its operational state almost immediately after the impact.

It is extremely important, in constructing this apparatus, to assure that the rate of absorption of the momentum of the evacuee 12 is controlled by the dynamic flow of air through the orifice 40, rather than by static air pressure considerations, or considerations relating to the weight of the material which must be accelerated by the impact. This is accomplished by using the lightest weight materials possible, especially for the upper panel 23 of impact chamber 19, and those portions of panels 23 and 25 which form the expansion chamber 51. Thus, the movement of these material panels, on impact, does not itself significantly affect the rate of deceleration of the body 12. In addition, use of the flap valve 73 to control inflation of the chamber 19 in response to its own size, rather than static pressure levels, assures complete inflation without permitting high pressure which would injure the evacuee 12. In addition, this pressure control is much less susceptible to inaccuracies than is a pressure switch mechanism, and thus less likely to fail and cause serious injury.

To make the fire evacuees 12 accessible to rescuers stationed around the perimeter of the disaster evacuation air cushion 11, a panel of nylon netting 71 is sewn to the top panel 23 of the upper air cushion 21 at a seam 24. The mesh of the nylon netting 71 is approximately two inches square and serves as finger grips for quickly pulling down the top edge of the upper air cushion 21 to enable the evacuee 12 to see the exit from a prone position. The netting 71 also serves as an access means for rescuers to reach unconscious victims, since the total height of the disaster evacuation air cushion unit 11 is typically at least 10 feet. A solid reinforcement nylon panel 73 is securely attached to the netting 71 to prevent the rescuers' or the victims' feet from becoming enmeshed in the netting during the retrieval operation. The netting 71 with its reinforcement panel 73 is also used for the outer wrapping of the deflected air cushion 11 when it is folded into a bundle for easy carrying and storage.

In summary, there has been described a disaster evacuation air cushion 11 which is fabricated from lightweight, flexible material, easily transported in its deflated state to the disaster site, such as a fire in a high-rise building, immediately inflated to its operational configuration, as shown in FIG. 1, by its own air blower motor 55. The apparatus has the ability to cushion repeated, rapid impacts of human bodies leaping from multistoried buildings by instantly recovering its operational configuration after impact through capture of exhaust air in the resilient expansion chamber 51. Although its use may be predominately for rescuing evacuees who are forced to leap from burning multistoried buildings when the normal escape routes or fire exits have been made inaccessible, it will be apparent that its utilization should not be restricted to such. For example, it can also be used to great advantage as a safety precaution measure for training circus performers or athletes, such as high-wire performers, trapezists, or tightrope acrobats.

What is claimed is:

1. Apparatus for absorbing the momentum of a falling object, comprising:

a primary, flexible, air-filled enclosure impacted by said falling object;

a secondary enclosure; and restrictive orifice means connecting said primary and secondary enclosures for permitting inflation of said secondary enclosure when said primary enclosure is impacted and for permitting reinflation of said primary enclosure by said secondary enclosure after said impact, said orifice means providing the primary path for the escape of air from said primary enclosure upon impact by said falling object.

2. Apparatus for absorbing the momentum of a falling object as defined in claim 1 wherein said secondary enclosure has a variable volume.

3. Apparatus for absorbing the momentum of a falling object, comprising:

a primary, flexible, air-filled enclosure impacted by said falling object;

a secondary enclosure having a variable volume;

restrictive orifice means connecting said primary and secondary enclosures for permitting inflation of said secondary enclosure when said primary enclosure is impacted and for permitting reinflation of said primary enclosure by said secondary enclosure after said impact; and means biasing said secondary enclosure toward a reduced volume.

4. Apparatus for absorbing the momentum of a falling object, comprising:

a primary, flexible, air-filled enclosure impacted by said falling object;

a secondary enclosure, said secondary enclosure surrounding the perimeter of said primary enclosure; and restrictive orifice means connecting said primary and secondary enclosures for permitting inflation of said secondary enclosure when said primary enclosure is impacted and for permitting reinflation of said primary enclosure by said secondary enclosure after said impact, said orifice surrounding the perimeter of said primary enclosure.

5. Apparatus for absorbing the momentum of a falling object as defined in claim 1 wherein said orifice is adjustable in size.

6. Apparatus for absorbing the momentum of a falling object, comprising:

a primary, flexible, air-filled enclosure impacted by said falling object;

a secondary enclosure;

restrictive orifice means connecting said primary and secondary enclosures for permitting inflation of said secondary enclosure when said primary enclosure is impacted and for permitting reinflation of said primary enclosure by said secondary enclosure after said impact; and means responsive to the physical size of one of said primary and secondary enclosures for controlling inflation of said primary enclosure.

7. Apparatus for absorbing the momentum of a falling object as defined in claim 6 wherein said inflation controlling means comprises:

a pump for supplying air to said primary enclosure;

a valve separating said primary enclosure from said pump; and means responsive to the physical size of said one of said primary and secondary enclosures for actuating said valve.

8. Apparatus for absorbing the momentum of a falling object as defined in claim 7 wherein said actuating means closes said valve prior to complete inflation of said one of said enclosure to prohibit high pressures in said primary enclosure.

9. Apparatus for absorbing the momentum of a falling object as defined in claim 1 wherein said primary enclosure is constructed of material having sufficiently light weight that the dynamics of air passing through said orifice substantially determines the rate of absorption of momentum of said falling object.

10. Apparatus for absorbing the momentum of a falling object, comprising:

a primary, flexible, air-filled enclosure impacted by said falling object;

a secondary enclosure;

restrictive orifice means connecting said primary and secondary enclosures for permitting inflation of said secondary enclosure when said primary enclosure is impacted and for permitting reinflation of said primary enclosure by said secondary enclosure after said impact; and a third enclosure forming a support for said primary enclosure, said third enclosure designed for placement on the ground beneath said primary enclosure and filled with air at a higher pressure than said primary enclosure.

11. Apparatus for absorbing the momentum of a moving object, comprising:

a flexible, air-filled enclosure impacted by said falling object; and means attached to said enclosure for receiving and collecting a majority of the air expelled from said enclosure at a controlled rate on impact, said means resupplying at least a portion of said collected air to said enclosure after impact.

12. Apparatus for absorbing the momentum of a moving object, comprising:

a flexible, air-filled enclosure impacted by said falling object;

means attached to said enclosure for receiving and collecting air therefrom at a controlled rate on impact, said means resupplying said collected air to said enclosure after impact;

a secondary enclosure of variable volume;

means biasing said secondary enclosure toward a reduced volume; and means interconnecting said flexible enclosure and said secondary enclosure, said means permitting airflow between said enclosures at a controlled rate.

13. Apparatus for absorbing the momentum of a moving object as defined in claim 12 wherein said interconnecting means comprises:

an orifice opening into each of said flexible and secondary enclosures.

14. Apparatus for absorbing the momentum of a moving object as defined in claim 13 wherein the size of said orifice is adjustable.

15. Apparatus for absorbing the momentum of a moving object as defined in claim 12 wherein said interconnecting means comprises:

a flexible wall member common to each of said flexible and secondary enclosures; and an orifice of predetermined size in said flexible wall member communicating with each of said enclosures.

16. Apparatus for catching people evacuating an elevated location, comprising:

a fist chamber having flexible walls, said first chamber positioned on the ground adjacent said elevated location;

means for inflating said first chamber to a first pressure;

a second chamber attached to and supported above said first chamber, said second chamber having flexible walls including an upper flexible wall for catching said evacuating people;

a third chamber communicating with said second chamber through an orifice, said third chamber having flexible walls; and resilient means attached to said third chamber and bearing on at least one wall of said third chamber, said resilient means biasing said third chamber toward a reduced volume configuration.

17. Apparatus for catching people evacuating an elevated location as defined in claim 16 wherein said second chamber is inflated to a second pressure less than said first pressure.

18. Apparatus for catching people evacuating an elevated location as defined in claim 17 additionally comprising:

an opening between said first and second chambers permitting fluid communication therebetween; and a valve for selectively closing said opening to permit selective inflation of said second chamber by air from said first chamber.

19. Apparatus for catching people evacuating an elevated location as defined in claim 18 wherein said valve comprises:

a flexible, air-impervious sheet; and means for selectively drawing said flexible air-impervious sheet across said opening.

20. Apparatus for catching people evacuating an elevated location as defined in claim 19 wherein said sheet drawing means comprises:

means attached to said third chamber for moving said sheet in response to movement of said flexible third chamber walls.

21. Apparatus for catching people evacuating an elevated location as defined in claim 20 additionally comprising:

means biasing said flexible sheet toward a position permitting airflow through said opening.

* * * * *

UNITED STATES PATENT AND TRADEMARK OFFICE

CERTIFICATE OF CORRECTION

PATENT NO. : 4,068,739

DATED : January 17, 1978

INVENTOR(S) : Donald W. Gordon and Dar A. Robinson

It is certified that error appears in the above-identified patent and that said Letters Patent are hereby corrected as shown below:

Column 4, line 37, change "difunctional" to --bifunctional-

Column 5, line 1, change "chanmber" to --chamber--; line 8, change second occurrence of "the" to --be--.

Column 7, line 17, change "deflected" to --deflated--.

Column 10, line 1, change "fist" to --first--.

Signed and Sealed this

*Sixteenth* Day of *May 1978*

[SEAL]

*Attest:*

RUTH C. MASON
*Attesting Officer*

LUTRELLE F. PARKER
*Acting Commissioner of Patents and Trademarks*